US007140127B2

(12) United States Patent
Yang

(10) Patent No.: US 7,140,127 B2
(45) Date of Patent: Nov. 28, 2006

(54) BODY FOR A SKATE BOOT

(75) Inventor: Willy H. Yang, Kaohsiung (TW)

(73) Assignee: Sakurai Sports Mfg. Co., Ltd. (TW)

( * ) Notice: Subject to any disclaimer, the term of this patent is extended or adjusted under 35 U.S.C. 154(b) by 308 days.

(21) Appl. No.: 10/940,027

(22) Filed: Sep. 14, 2004

(65) Prior Publication Data

US 2006/0053662 A1 Mar. 16, 2006

(51) Int. Cl.
*A43B 5/00* (2006.01)

(52) U.S. Cl. ..... 36/45; 36/115

(58) Field of Classification Search ..... 36/45, 36/115

See application file for complete search history.

(56) References Cited

U.S. PATENT DOCUMENTS 5,529,826 A * 6/1996 Tailor et al. ..... 428/110
6,319,599 B1 * 11/2001 Buckley ..... 428/308.4
6,422,577 B1 * 7/2002 Grande ..... 280/11.221
6,558,784 B1 * 5/2003 Norton et al. ..... 428/304.4
6,648,344 B1 * 11/2003 Grande ..... 280/11.221

* cited by examiner

*Primary Examiner*—Marie Patterson
(74) *Attorney, Agent, or Firm*—Hershkovitz & Associates; Abe Hershkovitz

(57) ABSTRACT

A body for a skate boot includes a sole portion, a toe portion extending from a front end of the sole portion, two upper portions extending from two sides of the sole portion, and a heel portion extending from a rear end of the sole portion. The sole portion, toe portion, upper portions and heel portion are made of fiber laminations constructed by multiple layers of fiber fabrics and epoxy resin by means of hot-pressing in a die. At least one thermoplastic substratum is provided in the fiber laminations at the upper portions and heel portion, and has two sewn portions respectively formed at two distal ends at the upper portions and extending out from the fiber laminations inside the thermoplastic substratum. Thus, the body is light-weight, has good shock resistance, and can cover the user's foot well.

8 Claims, 5 Drawing Sheets

BODY FOR A SKATE BOOT

BACKGROUND OF THE INVENTION

1. Field of the Invention

The present invention relates to a skate boot for an ice skate or in-line roller skate, and more particularly to a body of the skate boot.

2. Description of Related Art

Ice skates or in-line roller skates are generally composed of a body, a lining provided inside the body, a vamp spread over the body, and in-line rollers or an ice blade secured under the body. The body is generally made of a thermoplastic material such as PVC (polyvinyl chloride) by means of injection molding. Fiber material is sewn in the body as the lining, and leatheroid or texture fiber is spread outside a toe portion of the body. Thereafter, the rollers or ice blade is installed under a sole portion of the body.

The ice skates or in-line roller skates are used for high-speed sports such as speed skating or ice hockey, so the skates should have a low weight and cover a user's feet well. In the conventional skates, the body is made of the thermoplastic material such as PVC, which has a low strength to resist impact, and will become friable under a low temperature, so a thickness of the body should be maximized. However, the body with a large thickness will make the skate heavy and can not cover the user's feet in an effective manner, so it is difficult for the user to control the skates and move quickly.

Therefore, the invention provides a body for a skate boot to mitigate or obviate the aforementioned problems.

SUMMARY OF THE INVENTION

The main objective of the present invention is to provide a body for a skate boot which has a low weight, good shock resistance, and can cover a user's foot well.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
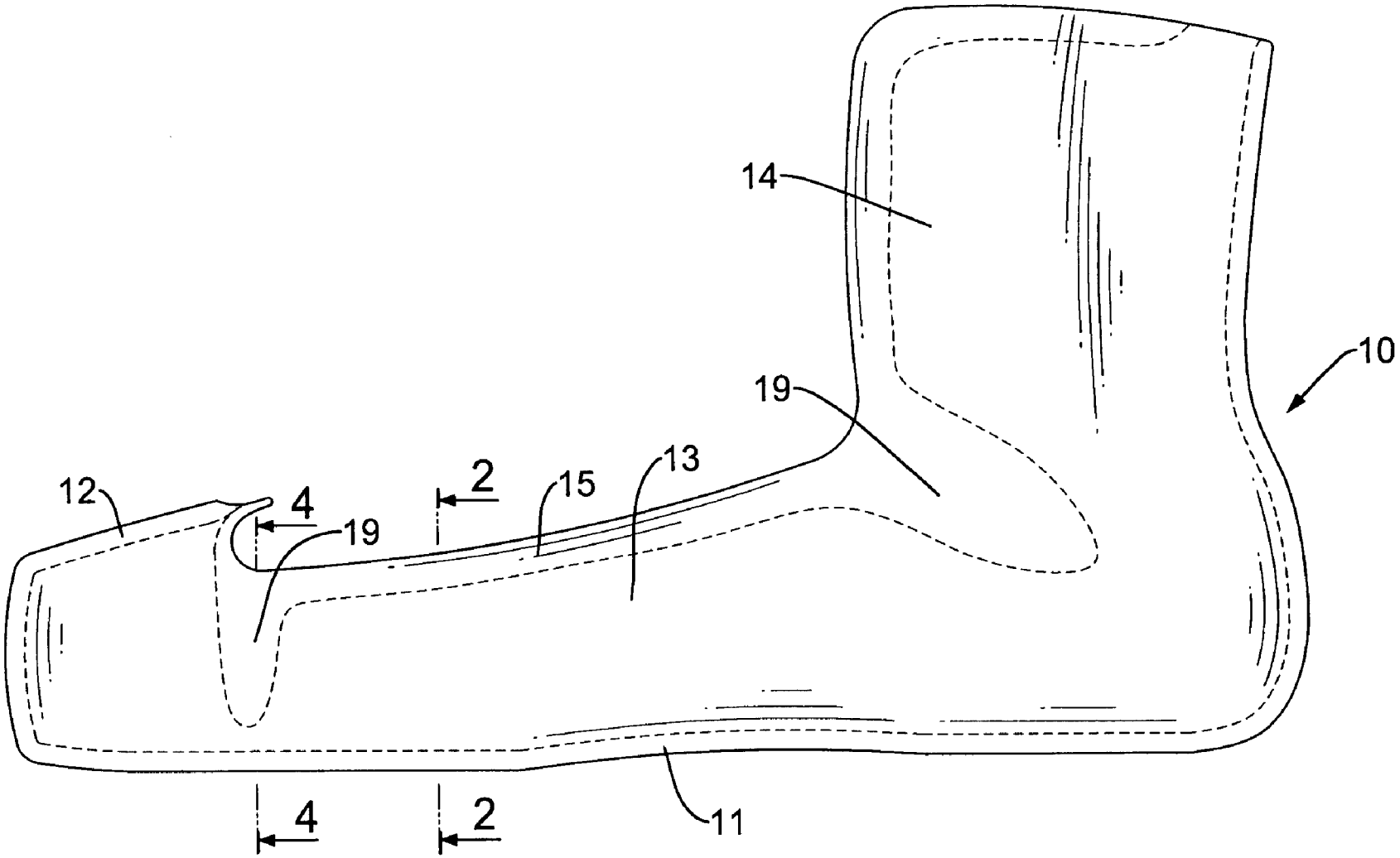
FIG. 1 is a front view of a body for a skate boot in accordance with the present invention.
Figure 2:
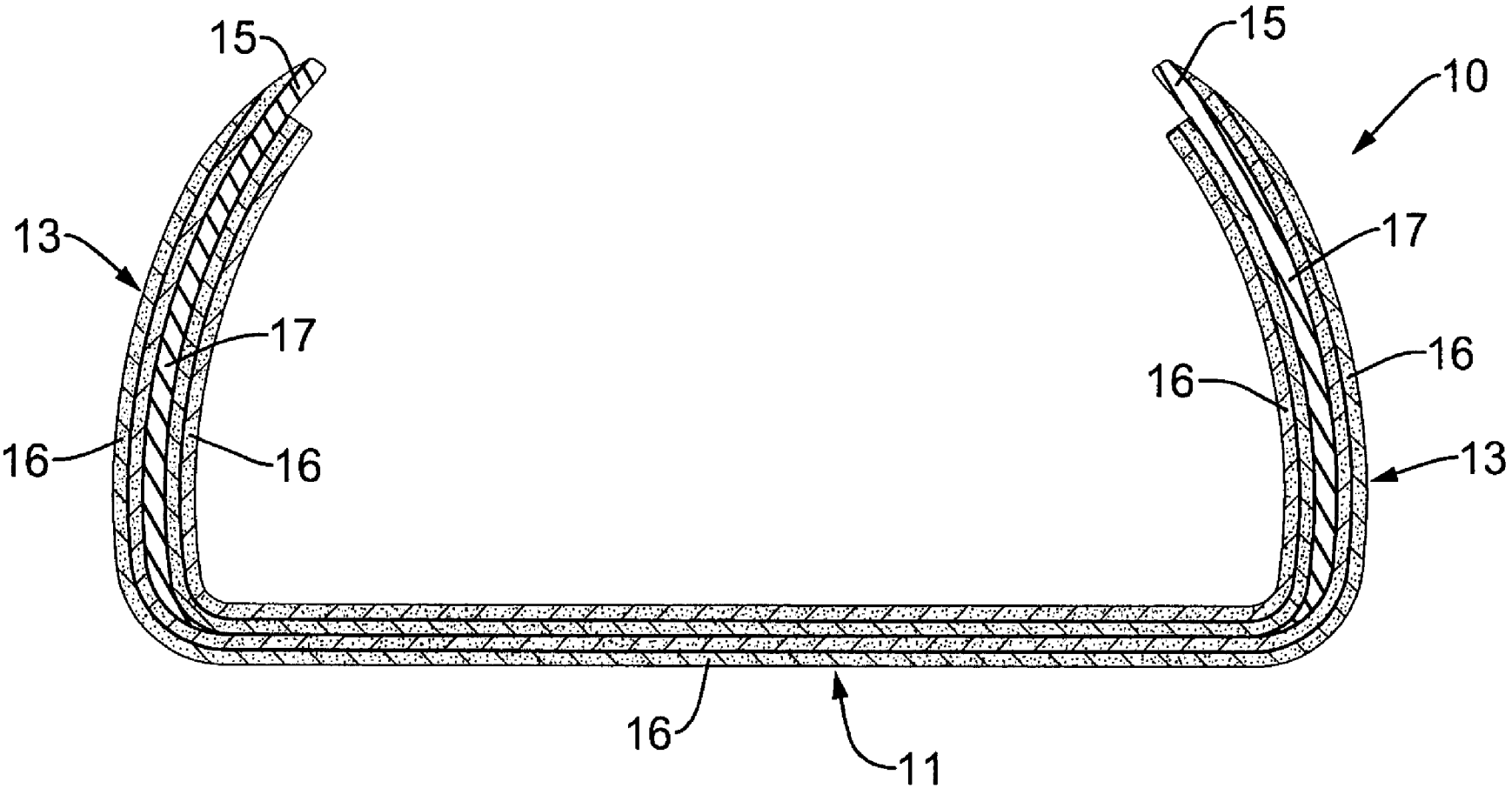
FIG. 2 is a side cross sectional view of the body along the line "2—2" in FIG. 1.

With reference to FIGS. 1–2, the body (10) for a skate boot in accordance with the present invention is composed of a sole portion (11) corresponding to a human's sole, a toe portion (12) extending from a front end of the sole portion (11), two upper portions (13) extending from two sides of the sole portion (11), and a heel portion (14) extending from a rear end of the sole portion (11).

The sole portion (11), toe portion (12), upper portions (13) and heel portion (14) are made of fiber laminations (16) constructed by multiple layers of fibrous fabrics and epoxy resin by means of die molding. At least one thermoplastic substratum (17) is provided in the fiber laminations (16) at the upper portions (13) and heel portion (14). At two distal ends of the thermoplastic substratum (17) at the upper portions (13), two sewn portions (15) are respectively formed and extend out from the fiber laminations (16) inside the thermoplastic substratum (17). The fiber laminations (16) outside the thermoplastic substratum (17) extend along and are adhered on the thermoplastic substratum (17).

Figure 3:
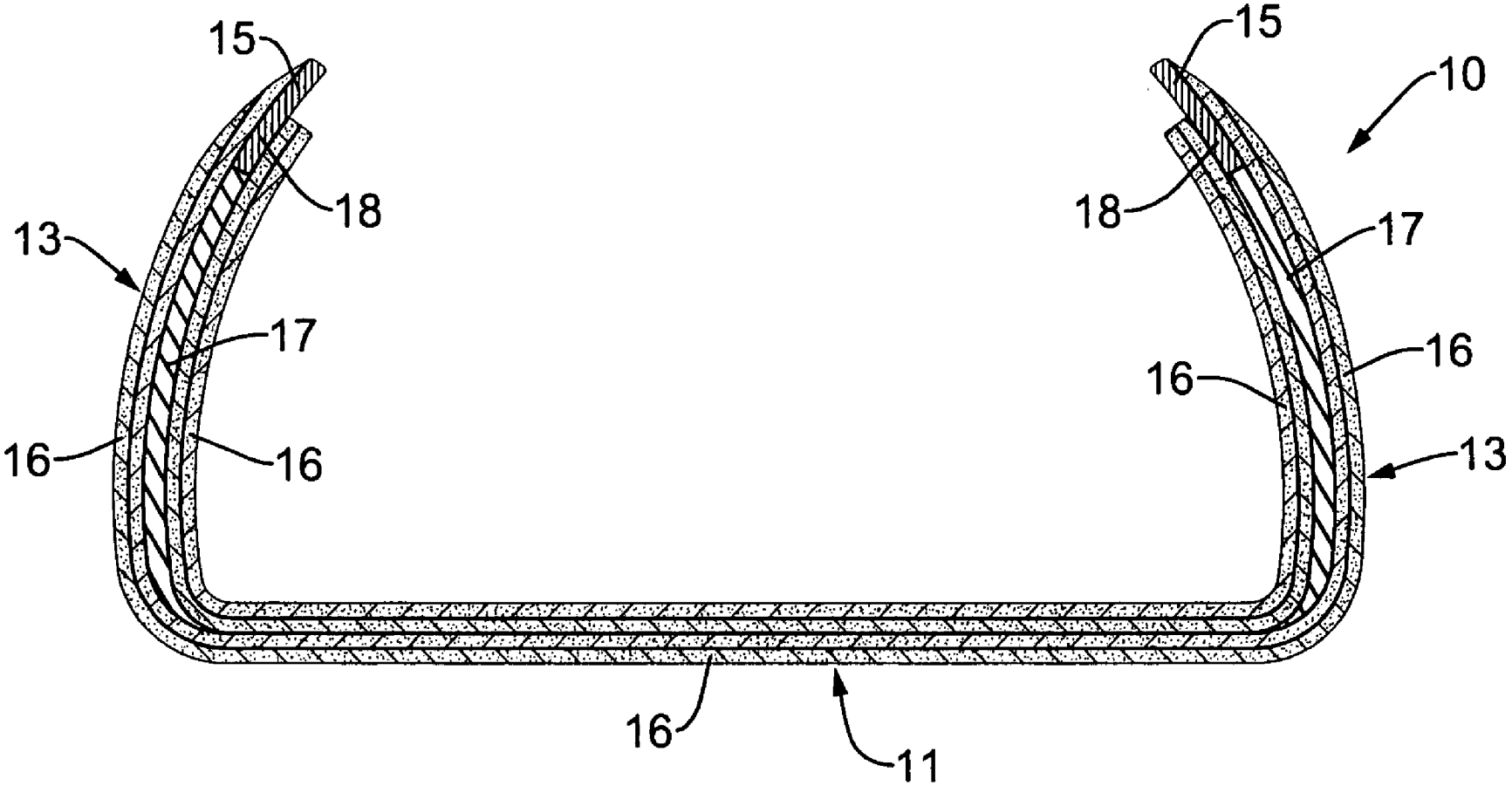
FIG. 3 is a side cross sectional view of another embodiment of the body in accordance with the present invention.

The fibrous fabrics in the fiber laminations (16) can be carbon fiber fabrics or other fiber fabrics with low weight and good shock resistance. The thermoplastic substratum (17) can be thermo plastic elastomer (TPE). As shown in FIG. 3, a top portion (18) of the thermoplastic substratum (17) can also be made of PU elastomer such as thermo plastic polyurethane (TPU).

Figure 4:
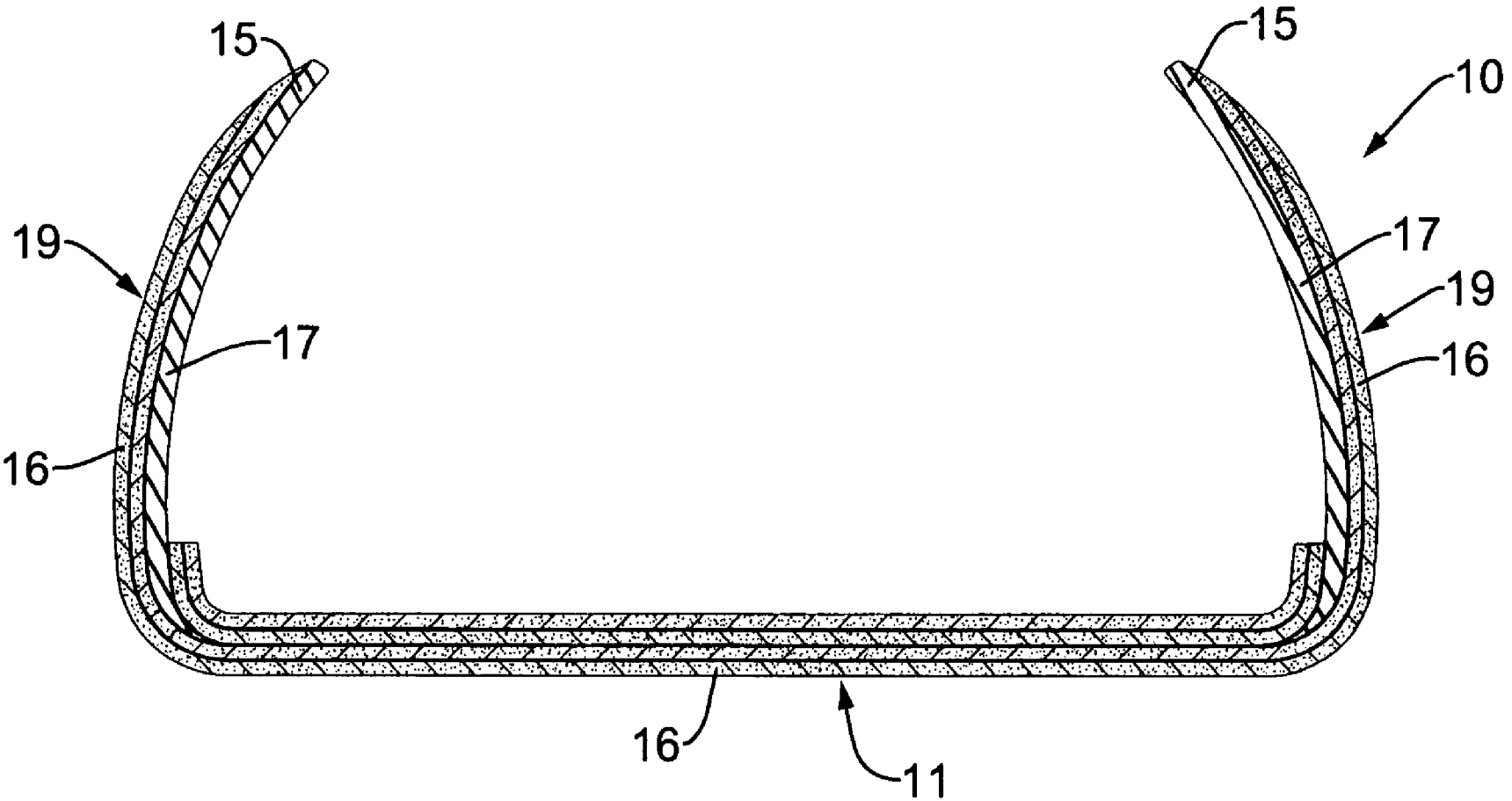
FIG. 4 is a side cross sectional view of the skate boot along the line "4—4" in FIG. 1.

With reference to FIGS. 1 and 4, bent portions (19) are respectively formed between the toe portion (12) and the upper portions (13) and between the heel portion (14) and the upper portions (13), and constructed by the thermoplastic substratum (17) and the fiber lamination (16) outside the thermoplastic substratum (17). Therefore, the body (10) has appropriate elasticity at the bent portions (19).

In manufacturing, the fiber fabrics and epoxy resin are alternately stacked in a die, and the thermoplastic substratum (17) is located in a determined position in the fiber fabrics. By hot pressing under special temperature, pressure and time, the body (10) is formed with a predetermined shape.

Figure 5:
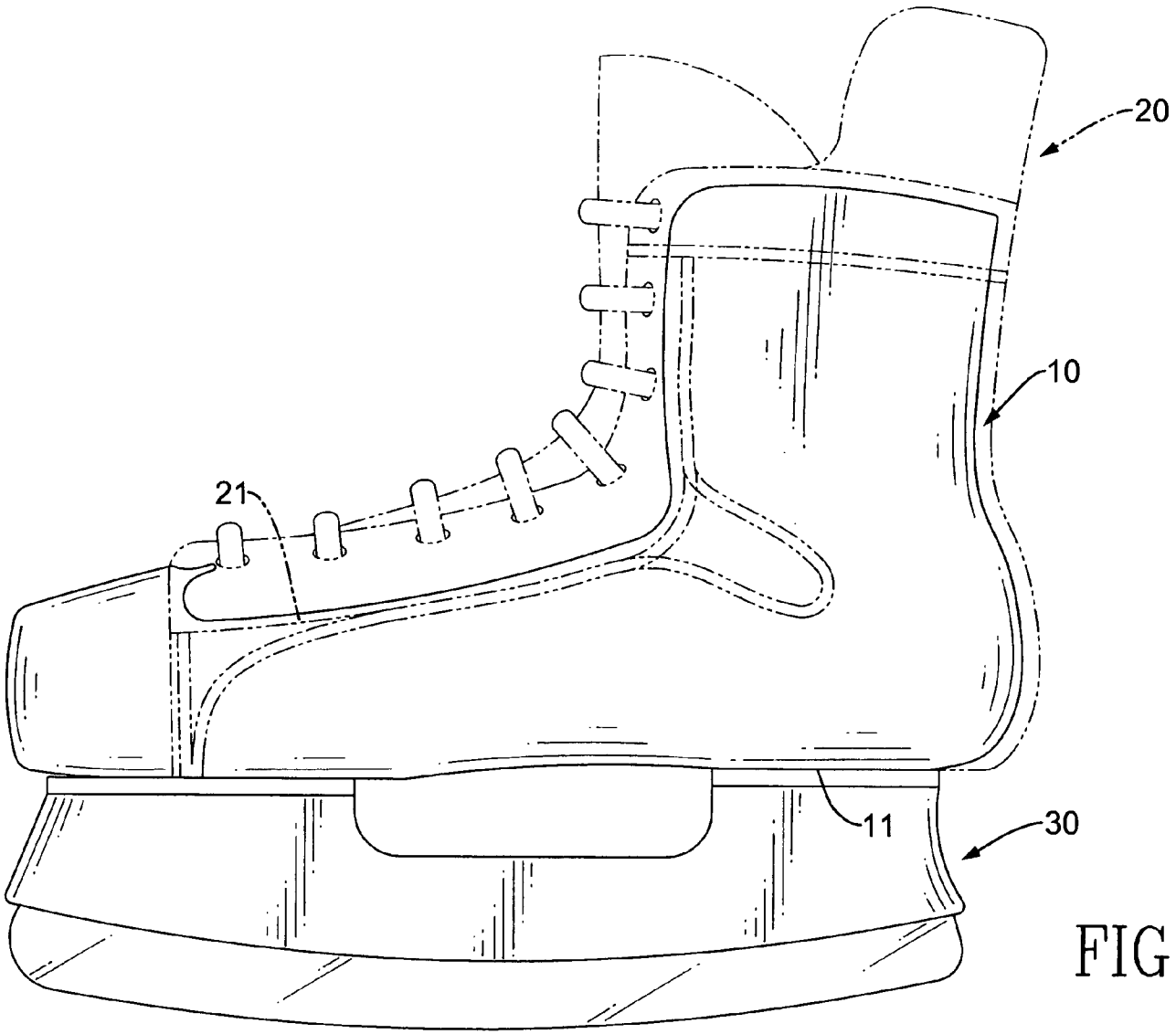
FIG. 5 is a front view of a skate boot with the body of the invention.

Afterwards, with reference to FIG. 5, an interior lining made of fibrous material is sewn on an inner side of the body (10). A vamp (20) of leatheroid or textile fibers is spread outside the body (10), and is sewn with the lining at the sewn portion (15). Finally, an ice blade (30) (or an in-line roller) is mounted under the body (10) to accomplish the skate boot.

When a user wears the skate boot for the first time, the skate boot should be heated before the user's foot is received in the skate boot. Thereafter, a bootlace on the skate boot is fastened to deform the body (10) to correspond to contours of the user's foot. When the skate boot is cooled to a normal temperature, the skate boot has an unchangeable configuration and can cover the user's foot very well.

Therefore, the body according to the present invention is made of light-weight and rigid fiber laminations by means of hot-pressing in a die, and has thermoplastic substratum provided in the fiber laminations. The body has advantages of being light-weight, having good shock resistance, and covering the user's foot well. Furthermore, the body can be slightly bent at the toe and heel portions to correspond to the movement of the foot.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A body for a skate boot, the body comprising:

a sole portion (11);

two upper portions (13) respectively extending from two sides of the sole portion (11); and a heel portion (14) extending from a rear end of the sole portion (11), wherein the sole portion (11), upper portions (13) and heel portion (14) are made of fibrous laminations (16) constructed, by multiple layers of fibrous fabrics and epoxy resin by means of hot-pressing in a die, at least one thermoplastic substratum (17) is provided in the fiber laminations (16) at the upper portions (13) and heel portion (14), and has two sewn portions (15) respectively formed at two distal ends at the upper portions (13) and extending out from the fiber laminations (16) inside the thermoplastic substratum (17).

2. The body as claimed in claim 1 further comprising a toe portion (12) extending from a front end of the sole portion (11), wherein the toe portion (12) is made of fibrous laminations (16) constructed by multiple layers of fibrous fabrics and epoxy resin by means of hot-pressing in a die.

3. The body as claimed in claim 1, wherein said fibrous fabric is a carbon fiber fabric.

4. The body as claimed in claim 1, wherein said thermoplastic substratum (17) is made of thermo plastic elastomer (TPE).

5. The body as claimed in claim 1, wherein a top portion of said thermoplastic substratum (17) is made of thermo plastic polyurethane (TPU) and a remainder portion of said thermoplastic substratum (17) is made of thermo plastic elastomer (TPE).

6. The body as claimed in claim 1, wherein said fiber laminations (16) outside the thermoplastic substratum (17) extend along and are adhered on the thermoplastic substratum (17).

7. The body as claimed in claim 1, wherein bent portions (19) are formed between the toe portion (12) and the upper portions (13), and constructed by the thermoplastic substratum (17) and the fiber lamination (16) outside the thermoplastic substratum (17).

8. The body as claimed in claim 1, wherein bent portions (19) are formed between the heel portion (14) and the upper portions (13), and constructed by the thermoplastic substratum (17) and the fiber lamination (16) outside the thermoplastic substratum (17).

* * * * *